United States Patent [19]

Zabava et al.

[11] 4,095,446

[45] Jun. 20, 1978

[54] CROSS ROLLING MILL

[76] Inventors: Jury Grigorievich Zabava, ulitsa Romen Rollana, 17, kv. 61; Rem Naumovich Kogan, ulitsa Njutona, 27, kv. 21, both of Kharkov; Ivan Mikhailovich Barabash, 2 Begovoi proezd, 8, kv. 32; Tadeush Valentinovich Svidnitsky, Volzhsky bulvar, 34, kv. 92, both of Moscow; Dzhan Alievich Lurie, pereulok I. Dubovskogo, 2, kv. 3, Kharkov; Elvira Alexeevna Bratslavskaya, ulitsa 8 Marta, 5, kv. 1, Kharkov; Mark Abramovich Lomazov, ulitsa Vorobieva, 9, kv. 3, Kharkov; Ilya Grigorievich Rodnyansky, ulitsa Bibliotechnaya, 16, kv. 33, Khimki Moskovskoi oblasti; Viktor Fedorovich Skorikov, ulitsa Pushkina, 10-a, kv. 5, Yaroslavl; Viktor Georgievich Surkov, ulitsa Tobolskaya, 50, kv. 31, Kharkov, all of U.S.S.R.

[21] Appl. No.: 769,292

[22] Filed: Feb. 16, 1977

[51] Int. Cl.[2] ..... B21H 1/18

[52] U.S. Cl. ..... 72/88; 72/442

[58] Field of Search ..... 72/88, 90, 442

[56] References Cited

U.S. PATENT DOCUMENTS 2,672,774 3/1954 Stern ..... 72/90

*Primary Examiner*—Lowell A. Larson

*Attorney, Agent, or Firm*—Fleit & Jacobson

[57] ABSTRACT

The invention relates to roll-forming of metals and can be advantageously utilized for cross rolling of workpieces in the form of solids of revolution in small-lot and lot production, where frequent replacement of working tools is required. The cross rolling mill of the invention comprises a housing in which guides perpendicular to the axis of rolling are capable of setting up swivel round axes perpendicular to the axis of rolling. Seated in the guides are slides which carry face-to-face positioned plain wedge-shaped tools that define a working pair having a clearance to accomodate the workpiece being rolled.

16 Claims, 8 Drawing Figures

CROSS ROLLING MILL

The present invention relates to pressure shaping of metals and more exactly to a mill for cross rolling of workpieces in the form of solids of revolution having variable cross-sections over the length thereof. Such workpieces are placed between and rolled by a working pair of plain wedge-shaped tools reciprocating with respect to each other along the axis of rolling.

The invention may be most efficiently utilized in automatic production lines designed for mass production of parts in small-lot and lot production where frequent resetting of working tools is required.

There are known mills for cross rolling of workpieces in the form of solids of revolution (cf., e.g., GDR Patent No. 57.585, Cl.7*a*4, dated 1967), comprising a housing which mounts guides located perpendicular relationship with the axis of rolling to accommodate therein slides carrying face-to-face positioned plain wedge-shaped tools that define a working pair having a clearance to accommodate the workpiece being rolled.

The guides of the slide in such mills are fixed in the housing rigidly, whereas traversing of slides along these guides is effected by means of self-contained hydraulic power cylinders accommodated in the spaces provided in the guides for this purpose.

Said known cross-rolling mills operate as follows. In the initial position one group of slides is displaced with respect to the other through a half of the stroke. Preheated blanks of parts are alternately brought into the clearance between the plain wedge-shaped tools.

Upon turning on the hydraulic power cylinders each group of slides together with plain wedge-shaped tools secured thereon travels along the guides towards the other group of slides.

During one working stroke of slides the blank (while rotating round its own axis) is rolled in between and by the working pair of plain wedge-shaped tools along the axis of rolling thus obtaining the required stepped shaping. Thereafter, the finished part is delivered to an outgoing conveyor, while the slides return to the initial position during an idle or return stroke of the hydraulic power cylinders.

The basic disadvantages of the known cross rolling mills lies in the fact that, for replacement of one working pair of wedge-shaped tools by another pair of wedge-shaped tools during the manufacture of parts variable in type and size, it is necessary to stop the mill, dismantle the slides together with one type of wedge-shaped tools and install the slides with another type of wedge-shaped tools.

All the above-listed operations are effected with the use of hand labour and special equipment, which makes them labour- and time-consuming, whereby the use of such mills proves to be unprofitable for cross rolling of workpieces in lot and small-lot production, where frequent replacement of working tools is required.

In addition, storage of slides with replaceable plain wedge-shaped tools takes more production floor area, while their transportation and mounting on the mill require some extra hauling facilities and handling equipment.

The object of the present invention is to provide a mill for cross rolling of workpieces in the form of solids of revolution, wherein replacement of the working tools could be effected automatically according to a given program, which would make it possible to substantially reduce the mill retooling time so as to handle workpieces of another type and size and thus to increase the mill output and permit its use in lot and small-lot production.

Another object of the invention is to provide a cross rolling mill which could be built into an automatic production line.

One more object of the invention is to reduce additional production floor area needed for storage of replaceable working tools.

These and other objects are achieved in the provision of a mill for cross rolling of workpieces in the form of solids of revolution, whose housing mounts guides located in perpendicular relationship with the axis of rolling to accommodate therein slides carrying face-to-face positioned plain wedge-shaped tools that define a working pair having a clearance adapted to accommodate the workpiece being rolled, wherein, according to the invention, the guides of the slides are so mounted in the housing as to be imparted setting-up swivel round axes perpendicular to the axis of rolling. The term "setting-up swivel" is used in its coventional sense in the machine tool industry to refer to the set-up of a working pair of tools to roll a work piece. The set-up is accomplished by swiveling or rotating the guides of the slides.

Such a constructional arrangement allows quick replacement of one working pair of plain wedge-shaped tools together with their slides and guides with another pair of wedge-shaped tools by means of a rotation or setting-up swivel of each group of guides round axes perpendicular to the axis of rolling without dismantling the slides with one type of wedge-shaped tools and installing the slides with another type of wedge-shaped tools. This allows the working tool replacement process to be automated without stopping the mill operation.

According to one of the possible embodiments of the present invention, the housing is split into upper and lower rigidly interconnected members, installed between these members are two adjustably rotatable drums which are so located that their axes are substantially vertical and perpendicular to the axis of rolling. An equal number of guides are formed on the generatrices of the side surfaces of these drums and equidistantly spaced along the perimeters or peripheries thereof. The slides mounted in the guides of one drum carry differently profiled plain wedge-shaped tools while the slides mounted in the guides of the other drum carry wedge-shaped tools mating with those in the first drum. The tools of the second drum during the up swivel of the durm are alternately brought into the rolling zone, opposite to their mating wedge-shaped tools of the first drum, to make up a working pair.

Such an embodiment allows the cross rolling mill to be provided simultaneously with several replaceable working pairs of wedge-shaped tools, and their mounting in the rolling position to be effected through setting up swivelling of drumns round their respective axes with further fixing them in that position, thus opening way for automation of the process of replacement of plain wedge-shaped tools and effecting this according to the given program.

The thus-improved cross rolling mill can be easily built into automatic production lines for operation according to the preset program in shops where widely diversified components are handled and produced in small lots. Automatic lines including such mills can be used in mass, lot and small-lot production.

In additional, this embodiment also permits repair, adjustment jobs and replacement of wedge-shaped tools to be effected without stopping the mill operation.

Setting up swivel of each drum can be effected with the help of a power-operated ratchet gear whose ratchet wheel is secured in place on the upper axle shaft of each drum, while the pivot of the pawl is fixed on a sleeve, coaxial with the drum, said sleeve being kinematically linked with the rod of the drum swivel hydraulic power cylinder.

This feature will make it possible to swivel each drum in a single direction.

It is expedient to install the drums between the members of the housing so that one is offset with respect to the other in the direction of the axis of rolling for a length equal to the stroke of the slides seated in the guides of the upper drum, while the slides seated in the guides of the lower drum are rigidly fixed in their guides.

This feature allows one actuator to be employed for an alternate traversing, in the course of rolling, of the slides seated in the guides of the upper drum relative to the stationary slides of the lower drum, thus simplifying the mill design.

The actuator for all the slides seated in the guides of the upper drum may take the form of a single hydraulic power cylinder whose cylinder proper is pivotally connected to the lower member of the housing, while the end of its rod through a splittable joint is attached to the slides positioned in the rolling zone.

It is likewise reasonable that the drums be installed in the housing with a possibility of being imparted setting-up movements in a direction perpendicular to the axis of rolling so as to adjst the clearance between the wedge-shaped tools in the rolling zone.

This feature extends the range of diameters of workpieces handled, thus making the mill more versatile.

The above-mentioned setting-up movements of each drum may be effected by means of adjusting screws, whereas the supporting portion of each of them is made spherical in shape and is adapted to interact with the support bearing of one of the axle shafts of the given drum.

Alternatively, the rolling mill of the invention may be provided with a mechanism for synchronous reciprocated movement of slides, mounted on a bed and comprised of a gear wheel brought into engagement with the slides during rolling operation, said slides being capable of travelling perpendicular to the axis of rolling. Said gear wheel is mounted on the driven axle shaft, with the axis thereof being parallel to the axis of rolling, and is free to travel along said axis.

Such constructional arrangement permits in-step movement of the wedge-shaped tools and enables the working stroke of hydraulic cylinders to be reduced by one half, which enhances the production rate of the mill.

It is advantageous that the gear wheel and the slides be brought into engagement by way of toothed racks fitted on the oppositely arranged surfaces of the slides.

Such engagement allows for most accurate synchronization of the oppositely directed movements of the tools.

It is expedient that the gear wheel be driven along the axis of rolling by means of a power cylinder.

It is preferable that a hydraulic cylinder by used as the power cylinder with the rod thereof being connected with the axle shaft of the gear wheel.

The preferance is given to a hydraulic cylinder because the main drive of the rolling mill is hydraulic as well.

The invention will be more clearly understood from the following detailed description of one of its possible embodiments given by way of example with reference to the accompanying drawings, wherein.

Figure 1:
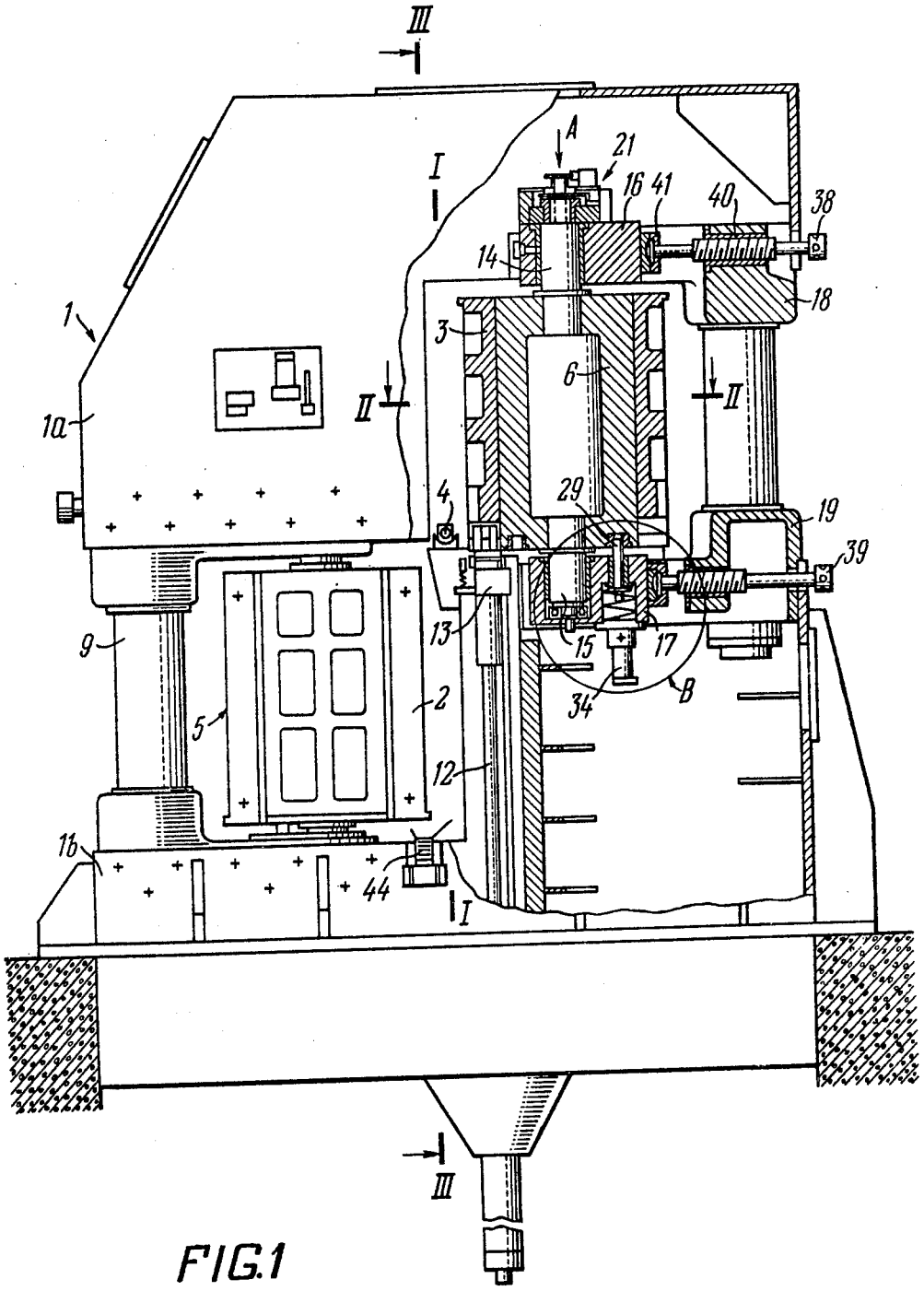
FIG. 1 is a general schematic view partially in section along the upper drum axis of a cross rolling mill, according to the invention.

The mill for cross rolling of workpieces in the form of solids of revolution comprises a housing 1 (FIG. 1), wherein guides are mounted in perpendicular relationship with an axis about which the workpiece being treated rolls, called the axis I—I of rolling, to accommodate slides 2 and 3 therein, carrying plain wedge-shaped tools positioned face-to-face in the course of rolling and defining a working pair forming a clearance left there between for a workpiece 4 being rolled.

According to the invention, the guides of the slides 2 and 3 are mounted in the housing 1 for rotation about axes perpendicular to the axis I—I of rolling for quick replacement of one working pair of plain wedge-shaped tools with another pair for rolling another type of workpiece.

To effect setting-up swivel of the guides of the slides 2 and 3, said guides are made over the generatrices of the side surfaces of two rotatable drums 5 and 6 respectively, installed in the housing 1 so that their axes are perpendicular to the axis I—I of rolling.

Figure 2:
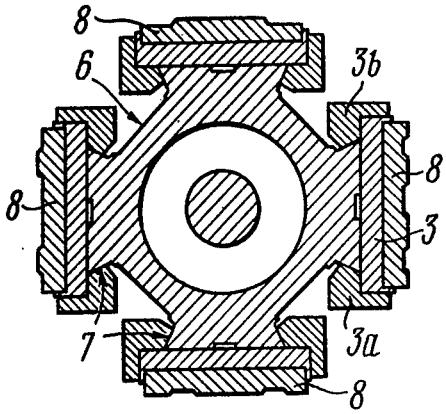
FIG. 2 is a scaled-up sectional view taken along the line II—II in FIG. 1.

These drums 5 and 6 may be provided practically with any similar number of guides 7 (FIG. 2) spaced equidistantly over the cross-sectional perimeter thereof. In the herein-described embodiment of the present invention the side surface of each drum 5 and 6 is provided with four pairs of the guides 7.

The slides 3 seated in the guides 7 of one drum 6 carry differently profiled wedge-shaped tools 8, while the slides 2 seated in the guides of the other drum 5 carry wedge-shaped tools 8 mating with the above ones.

In the course of synchronous setting-up rotation of the drums 5 and 6, the wedge-shaped tools 8 on one drum 5 are alternately brought into the rolling zone, opposite to their counterpart wedge-shaped tools 8 on the other drum 6, to define replaceable working pairs in the rolling zone.

For convenient disposition of the drums 5 and 6, the housing 1, according to the invention, is split into an upper member **1*a* and lower member 1*b* taking the form of hollow welded housings rigidly interconnected by means of four vertical columns 9, whereas the drums 5 and 6 are installed between said members 1*a* and 1*b* of the housing 1** in such a manner that their axes are substantially vertical and perpendicular to the axis I—I of rolling.

The drums 5 and 6, according to the invention, are offset relative to each other in the direction of the axis I—I of rolling for a length equal to the stroke of the slides 3 seated in the guides 7 of the upper drum 6, whereas the slides 2 of the lower drum 5 are rigidly secured to their guides with the help of splittable joints, such as bolt ones (not shown).

The slides 2 and 3 have the form of a rectangular plate. Rigedly secured to the upper slides 3 are shoes 3*a* and 3*b* embracing the guides 7 of the upper drum 6. The shoes 3*a* and 3*b*, together with the slides 3 are displaceable with respect to the guides 7.

Thus, cross rolling of each workpiece 4 is effected inbetween and by the working pair of the wedge-shaped tools 8 due to the displacement of the upper slide 3 within the guides 7 on the upper drum 6 relative to the stationary slides 2 secured on the lower drum 5.

Figure 3:
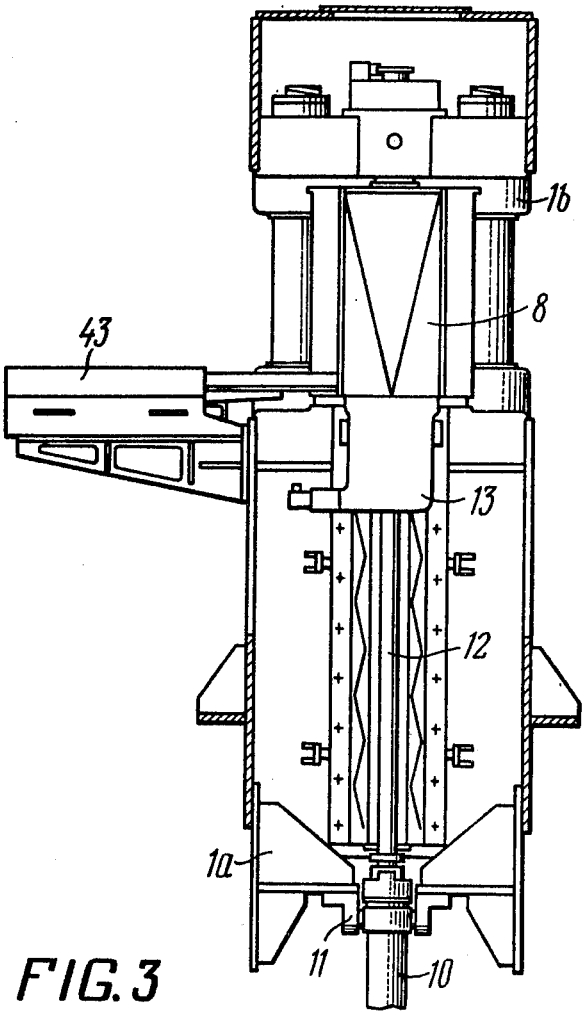
FIG. 3 is a sectional view taken along the line III—III in FIG. 1.

The reciprocating motion of all the upper slides 3 is effected alternately by means of a single hydraulic power cylinder whose cylinder proper 10 (FIG. 3) is secured on journals mounted by way of pivoted bushings (not shown) in brackets 11 secured in the lower member 1*b* of the housing 1, while the free end of the rod 12 of said hydraulic power cylinder is secured to the upper slide 3 positioned in the rolling zone by means of a damping means 13 made in the form of a grip.

Figure 6:
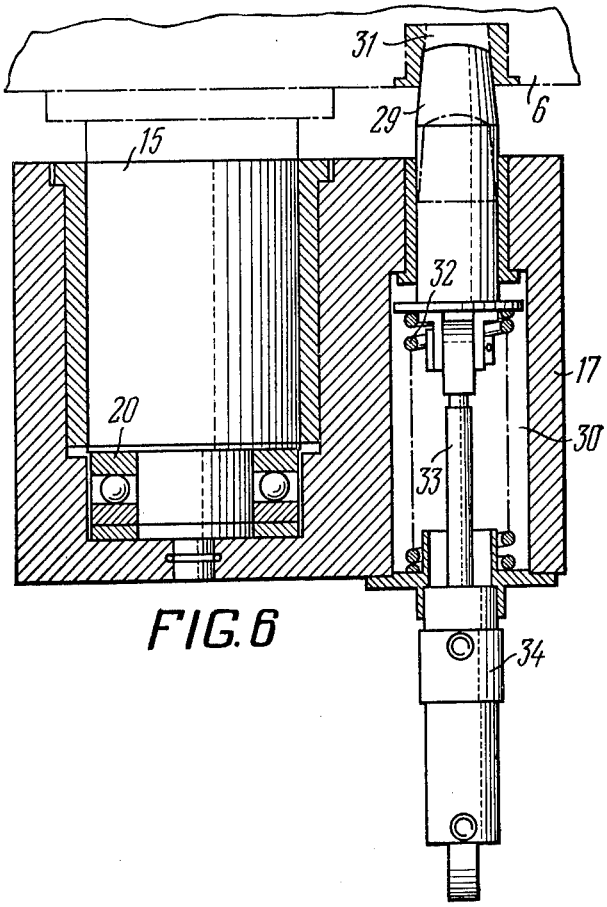
FIG. 6 is a scaled-up representation of the area "B" in FIG. 1.

Rididly attached to the both end faces of each drum 5 and 6 over the geometrical axes thereof are an upper axle shaft 14 (FIG. 1) and a lower axle shaft 15 installed in respective supports 16 and 17 mounted in supporting plates 18 and 19 of the upper member 1*a* and lower member 1*b* of the housing 1. The lower axle shafts 15 of the both drums 5 and 6 are installed in the lower supports 17 by means of ball thrust bearings 20 (FIG. 6).

Setting-up swivel of each drum 6 (5) for the replacement of one working pair of the plain wedge-shaped tools 8 with another pair is effected by means, of a ratchet gear, generally designated gear 21 (FIG. 1) mounted on the upper support 16 of the respective drum 6 (5).

Figure 4:
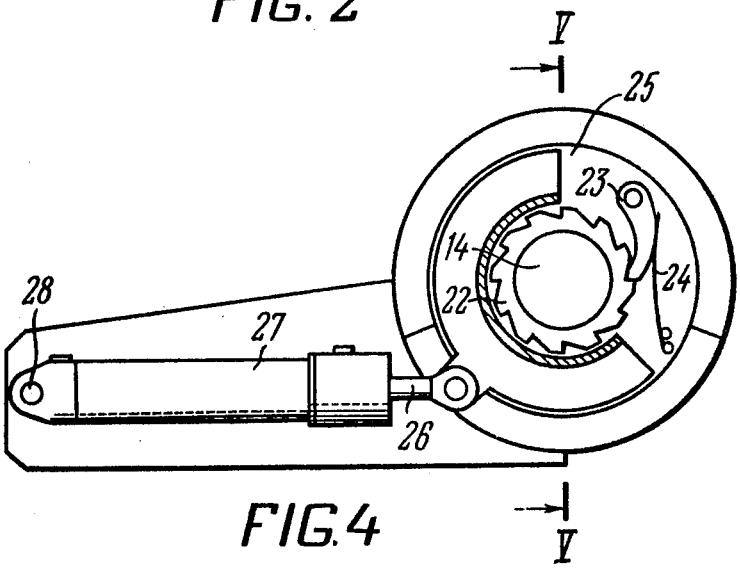
FIG. 4 is a scaled-up view taken along the arrow "A" in FIG. 1.

A ratchet wheel 22 (FIG. 4) of said ratchet gear 21 is rigidly secured on the upper axle shaft 14 of the drum 6 (5), while the pivot of a pawl 23 forced against the ratchet wheel 22 by a flat spring 24 is fastened on a swivel sleeve 25 mounted coaxially with the drum 6 (5), said sleeve being kinematically linked with a rod 26 of a hydraulic power cylinder 27 actuating the drum 6 (5). Said hydraulic power cylinder 27 is pivotally secured on a vertical pivot 28 installed on the housing of the ratchet gear 21.

One working stroke of the rods 26 of the hydraulic power cylinders 27 corresponds to a setting-up swivel of the drums 5 and 6 through 90°.

Each of the drums 6 (5) is held in each of the four positions by a lock 29 (FIG. 6) mounted in the lower support 17 of the corresponding drum 6 (5) in a through vertical passage 30 on the side of the lower end face of the drum 6 (5). Provided in this end face are four respective seats 31 spaced 90° apart for the lock 29 to engage, which is forced by a spring 32 against the end face of the drum 6 (5).

The lock 29 is removed from the seat 31 by a rod 33 of a hydraulic power cylinder 34 installed in the passage 30 on the other side of the lower support 17.

Figure 5:
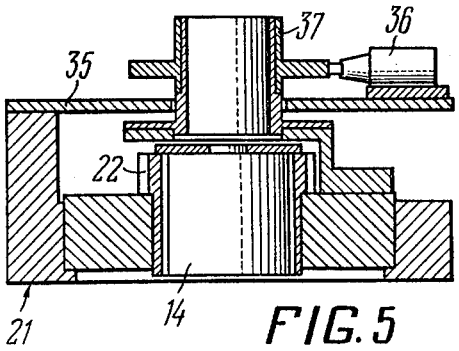
FIG. 5 is a sectional view taken along the line V—V in FIG. 4.

For co-operative action of the ratchet gears 21 and locks 29, there is a limit switch 36 mounted on a cover 35 (FIG. 5) of the housing of each ratchet gear 21, said limit switch co-operating with a cam bushing 37 slipped over the end of the upper axle shaft of each drum 6 (5).

Both drums 5 and 6 are installed in the housing adjustably movable in the direction perpendicular to the axis I—I of rolling so as to adjust or set the clearance between the plain wedge-shaped tools 8 installed in the rolling zone.

Said setting movements of each drum 6 (5) are effected by means of two adjusting screws 38 (FIG. 1) and 39 installed in threaded bushings 40 fixed in through holes made in the respective supporting plates 18 and 19, said screws co-operating, through their supporting part, with the bodies of the corresponding supports 16 and 17 of the axle shafts 14 and 15 of said drums 6 (5).

The supporting part of each screw 38 and 39 is spherical in shape and is attached by a clamp 41 to the body of the respective support 16 (17).

The cross rolling mill, according to the invention, can be operated either automatically according to the given program (if built in an automatic production line) or under an operator's control from a control desk.

Figure 7:
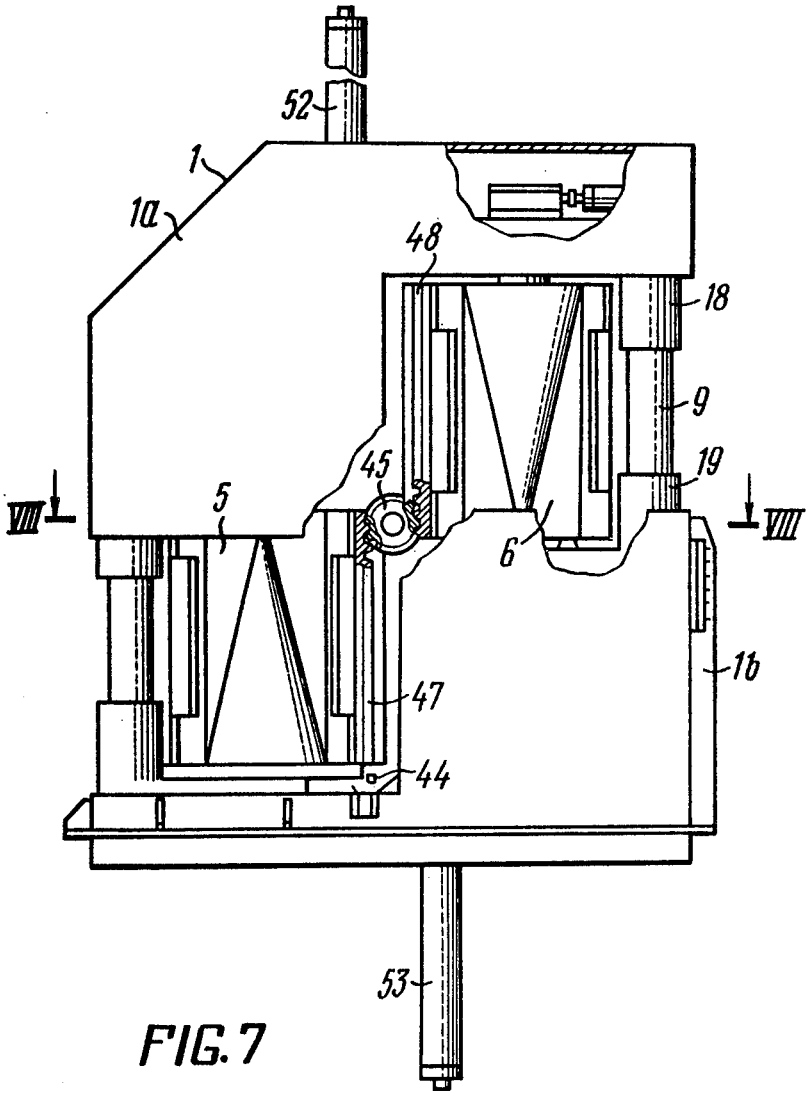
FIG. 7 shows an embodiment of the invention.
Figure 8:
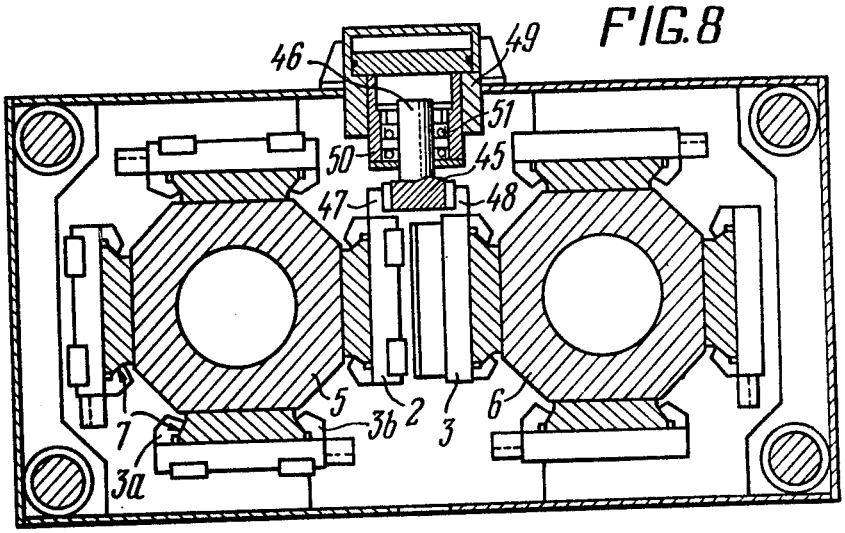
FIG. 8 is a cross-section taken along VIII—VIII of FIG. 7.

To carry out automatic replacement of the flat wedgeshaped tools, the rolling mill shown in FIGS. 7 and 8, is provided with a mechanism for synchronous reciprocated movement of slides 2 and 3, carrying said tools, and mounted on the bed 1. The mechanism comprises a gear 45 which is brought into engagement with the slides 2 and 3 during rolling operation. The gear 45 is mounted on a driven axle shaft 46 for movement along the axis I—I of rolling. The geometric axis of the driven axle shaft 46 is parallel to the axis I—I of rolling.

The gear wheel 45 is brought into toothed engagement with the slides 2 and 3 by means of toothed racks 47 and 48 fitted on the oppositely arranged surfaces of the slides 2 and 3, respectively.

The gear wheel 45 is driven along the axis I—I of rolling by means of a power cylinder. Used for this purpose is a hydraulic cylinder 49 with a rod 50 thereof being associated with the axle shaft 46 of the gear wheel 45 by means of antifriction bearings 51.

Reciprocated movement, perpendicular to the axis I—I of rolling, of the bottom slides 2 is carried out alternatively by means of a hydraulic cylinder 52, and that of the top slides 3, by means of a hydraulic cylinder 53.

The mill operates as follows.

In the initial position, the upper slides 3 with their plain wedge-shaped tools 8 installed in the rolling zone are found in their uppermost position within the guides 7 of the upper drum 6 and by means of the clamp 13 are connected to the rod 12 of the hydraulic power cylinder which effects the reciprocating motion of the upper slide 3 along the guides 7 of the drum 6.

The blank 4 to be rolled in brought onto an intake device 43 (FIG. 3) and further into the clearance defined by the pair of the plain wedge-shaped tools 8 positioned in the rolling zone.

Once the hydraulic power cylinder is actuated, its rod 12 urges the upper slides 3 to move along the guides 7 of the upper drum 6 together with the wedge-shaped tools 8 secured thereon downwards with respect to the lower stationary slide 4 secured on the lower drum 5 and carrying the wedge-shaped tools 8 mating with those mentioned above.

In the course of said traverse of the upper slide 3, the blank 4 while rotating round its own axis is being rolled along the wedge-shaped tools inbetween the working pair of the plain wedge-shaped tools 8, thus assuming the required shape. Thereafter, the finiahed part 4 goes onto a conveyor 44 (FIG. 1) for delivery into the finished product bin (not shown). During its return stroke the rod 12 of the hydraulic power cylinder moves the upper slide 3 with an intake device to the initial position, said slide receiving a next blank, and the rolling cycle is then repeated.

After the mill has rolled an assigned lot of parts 4 of a certain shape, the hydraulic power cylinder is disengaged (automatically or from the control desk 42) and the hydraulic cylinder rod 12 is disengaged from the upper slides 3.

Then, the hydraulic power cylinders 34 are actuated and their rods 33 disengage the locks 29 from the seats 31 in the lower end faces of the drums 5 and 6, thus releasing the latter for their subsequent setting up swivel to replace the working pair of the wedge-shaped tools 8.

For this purpose, the hydraulic power cylinders 27 of the ratchet gears 21 are actuated. The rod 26 of each of said hydraulic power cylinders 27, while acting through the swivel sleeve 25, the pawl 23 and the ratchet wheel 22 co-operating with the pawl, turns the corresponding drum 5 and 6 through 90°. As a result, brought into the rolling zone are the plain wedge-shaped tools 8 of the next working pair of rolling the workpieces 4 of another type and size. During the setting-up swivel of the drums 5 and 6, sensors 36 turn off the hydraulic power cylinders 34, while the springs 32 move the locks 29 into the corresponding seats 31 in the lower end faces of the drums 5 and 6 to retain them in a new position relative to each other in the course of rolling.

Then, the hydraulic cylinder rod 12 is again connected by the clamp 13 to the upper slide 3 brought into the rolling zone due to the swiveling of the drums 5 and 6 through 90°, and the mill is now ready for rolling the blanks of another lot of the workpieces 4.

Each of the drums 5 and 6, in the slides 2 and 3, carries an assigned set of the plain wedge-shaped tools 8 which can be dismantled or replaced with others during retooling or the mill.

Should the distance between the wedge-shaped tools 8 in each working pair of varied, the drums 5 and 6 are displaced in the direction perpendicular to the axis I—I of rolling by means of the adjusting screws 38 and 39.

In the course of simultaneous turning in or out of said screws 38 and 39, the supports 16 and 17 of the axle shafts 14 and 15 of the drums 6 (5), co-operating with the spherical supporting parts of said screws will move said drums 6 (5) along the respective guides (not shown) provided in the supporting plates 18 and 19 of the housing 1, in the direction perpendicular to the axis I—I of rolling.

With the embodiment of FIGS. 7 and 8, on completion of a rolling operation and on producing a prescribed amount of articles with a requisite profile, the rolling mill is stopped automatically. The power cylinder 49 is actuated, said cylinder having its ord 50 associated with the axle shaft 46 to the gear wheel 45, and disengages the latter from the toothed racks 47 and 48 mounted on the bottom and top slides 2 and 3, respectively. The hydraulic cylinders 52 and 53 are disengaged from the slides 2 and 3 by means of the clamp 13 (see FIG. 1) fitted on each of the rods (see FIG. 3) of the hydraulic cylinders 52 and 53. Thence, the hydraulic cylinders 34 (see FIG. 6) are actuated, said cylinders having their rods 33 forcing the locks 29 out of the seats 31 in lower faces of the drums 5 and 6 thereby releasing them for subsequent setting-up rotation to replace the working pair of the wedge-shaped tools. To this end the hydraulic cylinders 27 (FIG. 4) of the ratchet gear 21 cause the drums 5 and 6 to swivel through 90° which results in setting-up of the flat wedge-shaped tools of the next working pair.

In the course of setting-up rotation of the drums 5 and 6, the sensors 36 (FIG. 5) turn off the hydraulic cylinders 34 (FIG. 6), while the springs 32 move the locks 29 into the corresponding seats 31 (FIG. 6) in the lower end faces of the drums 5 and 6 to retain them in a new position relative to each other in the course of rolling. The rods of the hydraulic cylinders 52 and 53 are thence reconnected by the clamp 13 to the slides 2 and 3, respectively.

The power cylinder 49 is then actuated and the rod 50 thereof set to move the shaft 46 which, in turn, operates to engage the gear 45 with the toothed racks 47 and 48, mounted on the slides 2 and 3, and the rolling mill is thus put into operation.

We claim:

1. A mill for cross rolling of workpieces in the form of solids of revolution, the workpieces moving in a direction perpendicular to an axis of rolling during the cross rolling comprising: a housing formed of two rigidly interconnected upper and lower members; two rotatable drums adjustably installed between the upper and lower members of said housing so that the axes of the drums are substantially vertical and perpendicular to the axis of rolling; guides positioned on the gener atrices of the side surfaces of each of said drums and spaced equidistantly over the periphery of said drums; first slides seated in said guides of one of said drums; first tool means having differently profiled wedge-shapes and carried by said first slides; second slides seated in the guides of the other of said drums; second tool means having wedge-shapes mating with said shapes of said first tool means and carried by said second slides, the rotation of said drums allowing setting-up of different mating pairs of said first and second tool means to bring same into proximity with the axis of rolling for cross rolling workpieces.

2. A mill as set forth in claim 1, further including power-operated ratchet gear means for rotating each of said drums and having a ratchet wheel ridigly fastened on an upper axle shaft of each of said drums, a pawl pivot secured on a sleeve installed coaxially with eadh of said drums, and a rod of a hydraulic cylinder kinematically linked to each of said pawl pivots for rotating said drums.

3. A mill as set forth in claim 1, wherein the first slides are displaceable with respect to said one drum by a stroke distance sufficient to accomplish the cross rolling of the workpieces and wherein the drums are installed in the housing with said one drum positioned above said other drum in the direction perpendicular to the axis of rolling by a distance equal to the stroke of said first slides, the second slides being rigidly secured in their guides.

4. A mill as set forth in claim 3, further including a hydraulic power cylinder pivotally secured in the lower member of the housing with the end of the rod of said hydraulic power cylinder being connected by joint means to said first slides for displacing said first slides with respect to said one drum.

5. A mill as set forth in claim 1, wherein the drums are installed in the housing in such manner as to provide for settingup movements of the drums in a direction perpendicular to the axis of rolling thereby allowing adjustment of the clearance between the wedge-shaped tools brought into proximity with the axis of rolling.

6. A mill as set forth in claim 5, further including adjusting screws for controlling the setting-up movements of each drum, each screw having a supporting part spherical in shape and co-operating with a support of an axle shaft of each drum.

7. A mill as claimed in claim 1, wherein said slides include gear means and wherein said mill further includes movement means for synchronous reciprocated movement of said slides, said movement means being mounted on the housing and comprising a gear engageable with said gear means on the slides and movable is a direction perpendicular to the axis of rolling and a driven shaft mounting said gear and having the axis thereof parallel to the axis of rolling, the shaft being movable along said axis.

8. A mill as claimed in claim 7, wherein said gear means comprises toothed racks fitted on oppositely arranged surfaces of said slides.

9. A mill as claimed in claim 7, further including a power cylinder for moving said gear along the axis of rolling.

10. A mill as claimed in claim 9, wherein the power cylinder is a hydraulic cylinder having the rod thereof positioned to move said driven shaft.

11. A mill for cross rolling of workpieces in the form of solids of revolution, the workpieces moving perpendicular to an axis of rolling and rotating about the axis of rolling during the cross rolling, said mill comprising:

housing means;

first guide means rotatably installed in said housing means with an axis perpendicular to the axis of rolling;

second guide means rotatably installed in said housing means with an axis perpendicular to the axis of rolling and parallel to the axis of said first guide means;

slides positioned in each said guide means;

a wedge-shaped tool carried by each of said slides such that said first and said second guide means setup position a pair of tools in a spaced apart, face-to-face relationship defining a working pair of tools for a workpiece positionable in the space defined between the working pair of tools;

means for rotating said first and said second guide means for selectively forming different working pairs of tools; and means for relatively moving said first and said second guide means perpendicular to the axis of rolling so that the selected working pair of tools will cross roll a workpiece positioned therebetween.

12. A mill as claimed in claim 11 wherein the slides positioned in said first guide means are movable with respect to said first guide means and the slides positioned in said second guide means are fixed with respect to said second guide means.

13. A mill as claimed in claim 11 wherein the slides positioned in each of said guide means are movable with respect to said guide means.

14. A mill as claimed in claim 11 further including means for moving each of said first and second guide means to adjust the width of the space defined between the working pair of tools.

15. A mill as claimed in claim 11 further including means for releasably holding each of said first and second guide means in predetermined positions in which said first and second guide means form said different working pairs of tools.

16. A mill as claimed in claim 11 further including drums for supporting said guide means, said drums being rotatably installed in said housing means with a plurality of guides spaced equidistantly around the periphery of each of said terms.

* * * * *